US008446086B2

(12) United States Patent
Sugimura et al.

(10) Patent No.: US 8,446,086 B2
(45) Date of Patent: May 21, 2013

(54) FLUORESCENT LAMP ELECTRODE, METHOD FOR PRODUCING SAME, AND A FLUORESCENT LAMP

(75) Inventors: Toshikazu Sugimura, Shinagawa-ku (JP); Tatsuya Takahashi, Minato-ku (JP); Isao Kawanishi, Minato-ku (JP); Nobuki Mori, Minato-ku (JP); Akikazu Tanaka, Minato-ku (JP)

(73) Assignees: NEC Lighting, Ltd., Tokyo (JP); Sumitomo Metal Mining Co., Ltd., Tokyo (JP)

( * ) Notice: Subject to any disclaimer, the term of this patent is extended or adjusted under 35 U.S.C. 154(b) by 59 days.

(21) Appl. No.: 13/000,295

(22) PCT Filed: May 29, 2009

(86) PCT No.: PCT/JP2009/059837
§ 371 (c)(1), (2), (4) Date: Apr. 8, 2011

(87) PCT Pub. No.: WO2009/157270
PCT Pub. Date: Dec. 30, 2009

(65) Prior Publication Data

US 2011/0181177 A1 Jul. 28, 2011

(30) Foreign Application Priority Data

Jun. 25, 2008 (JP) ..... 2008-165714

(51) Int. Cl.
*H01J 63/04* (2006.01)

(52) U.S. Cl.
USPC ..... 313/491; 252/513

(58) Field of Classification Search
USPC ..... 313/491–493
See application file for complete search history.

(56) References Cited

FOREIGN PATENT DOCUMENTS

| | | | | |
|---|---|---|---|---|
| JP | 04-272109 | A | | 9/1992 |
| JP | 07-166261 | A | | 6/1995 |
| JP | 3067661 | B2 | | 5/1998 |
| JP | 2005-183172 | A | | 7/2005 |
| JP | 2005183172 | A | * | 7/2005 |
| JP | 2007-026801 | A | | 2/2007 |
| JP | 2007-173197 | A | | 7/2007 |
| JP | 2008130507 | A | * | 6/2008 |

* cited by examiner

*Primary Examiner* — Anh Mai
*Assistant Examiner* — Brenitra M Lee
(74) *Attorney, Agent, or Firm* — Sughrue Mion, PLLC

(57) ABSTRACT

Provided is a fluorescent lamp electrode, having excellent sputtering resistance and able to retain excellent dark-start characteristics over a long period of time when used as an electrode in a cold cathode fluorescent lamp, and which can be produced inexpensively. A fluorescent lamp of this invention has a prolonged life resulting from the use of said electrode. Said electrode is made by dispersing in a nickel or nickel alloy base one or more rare earth metals selected from among lanthanum, cerium, yttrium, samarium, praseodymium, niobium, europium and gadolinium in the form of a precipitated boride phase.

7 Claims, 4 Drawing Sheets

(a)

(b)

(a)

(b)

Secondary electrons image

La (appearing as white)

B (appearing as white)

FLUORESCENT LAMP ELECTRODE, METHOD FOR PRODUCING SAME, AND A FLUORESCENT LAMP

CROSS REFERENCE TO RELATED APPLICATIONS

This application is a National Stage of International Application No. PCT/JP2009/059837, filed on May 29, 2009, which claims priority from Japanese Patent Application No. 2008-165714 filed on Jun. 25, 2008, the contents of all of which are incorporated herein by reference in their entirety.

TECHNICAL FIELD

The present invention relates to a fluorescent lamp electrode, a method for producing the same and a fluorescent lamp including the fluorescent lamp electrode. In particular, the invention relates to a fluorescent lamp electrode having excellent sputtering resistance, a method for producing the same and a fluorescent lamp including the fluorescent lamp electrode.

BACKGROUND ART

A fluorescent lamp is used as not only a hot electrode fluorescent lamp for general lighting but also a cold cathode fluorescent lamp for a backlight of a liquid crystal display set in a device such as a television or a computer, a scanning light source of a facsimile or an eraser light source of a copying machine, or an external electrode fluorescent. The fluorescent lamp has a light transmitting tube made of a glass with a fluorescent layer on an inner wall surface thereof; and electrodes internally or externally installed to both ends of the light transmitting tube. Mercury and rare gas such as argon are enclosed in the light transmitting tube. Fluorescence may occur in a following way. When a voltage is applied between fluorescent lamp electrodes, electrons emitted in the light transmitting tube ionize rare gas. Then, the ionized rare gas is attracted to the electrodes and in turn secondary electrons are emitted from the electrodes, thereby generating glow discharge. The mercury is excited by the glow discharge to emit ultraviolet ray and then the fluorescent material excited by the ultraviolet ray emits the fluorescence in a range of visible rays.

The electrodes in such a fluorescent lamp are subjected to the sputtering of the mercury or the ionized rare gas so that atoms in the electrodes are beaten out of the electrodes. Accordingly, the electrodes are easily deteriorated, resulting in the shortened life time of the fluorescent lamp. For this reason, material of the electrodes is selected to have excellent sputtering resistance. The material of the electrodes in the fluorescent lamp has employed nickel or nickel alloy because the nickel or nickel alloy has the excellent sputtering resistance and is easy-manufacturing at low cost. However, the nickel atoms beaten out of the electrodes by sputtering tend to react with the mercury to generate amalgam. Further, with the deterioration of the electrodes, the mercury may be consumed to shorten the life time of the fluorescent lamp.

Moreover, the cold cathode fluorescent lamp is frequently used under darkness where it is difficult for external electrons to reach inside the lamp, and, hence, it takes long time for the secondary electrons to be emitted from the electrodes after a start voltage is applied to both electrodes. Such a cold cathode fluorescent lamp, in which hot electrons are not expected to be emitted from the electrodes, may put the light on within 20 to 30 milliseconds under the presence of ambient light after high frequency high voltage in a range of 50 to 60 kHz and 1000 to 1200 V is applied to both electrodes, whereas the cold cathode fluorescent lamp may not put the light on immediately under the darkness, and it takes more than one second to light up. Occasionally it never lights up. In this manner, under the darkness, the cold cathode fluorescent lamp has extremely unstable starting characteristics.

In order to improve such extremely unstable starting characteristics of the cold cathode fluorescent lamp, Patent Documents 1, 2 disclose the discharge lamp including an electron emitter layer made of $LaB_6$ or $CeB_6$ as the electron emitting material formed on the surface of the electrodes.

In such discharge lamps disclosed in the Patent Documents 1, 2, however, the electron emitter layer made of the electron emitting material is formed on the surface of the electrodes, hence, the electron emitting material has been consumed out by the sputtering during the use of the discharge lamps. Accordingly, it has a problem that such discharge lamps do not remain good dark-start characteristics for long periods.

PRIOR DOCUMENTS

Patent Documents

Patent Document 1: Japanese Patent No. 3067661

Patent Document 2: Japanese Patent Laid-Open No. 2007-26801

SUMMARY OF INVENTION

Technical Problem

An problem of the invention is to provide a fluorescent lamp electrode having excellent sputtering resistance and being able to retain excellent dark-start characteristics over a long period of time when used as an electrode in a cold cathode fluorescent lamp; and a fluorescent lamp having a prolonged life time resulting from the use of the fluorescent lamp electrode. Moreover, another problem of the invention is to provide a method for producing the fluorescent lamp electrode easily and inexpensively.

Solution to Problem

Applicants of the present invention have examined various electron emitting materials which may be employed in the fluorescent lamp electrode. As a result, it has been discovered that by dispersing in a nickel or nickel alloy base specified rare earth metals in the form of a precipitated boride phase, the fluorescent lamp electrode may be acquired having excellent sputtering resistance and being able to retain excellent dark-start characteristics over a long period of time when used as an electrode in the cold cathode fluorescent lamp. The invention is based on such findings.

To be specific, the invention relates to the fluorescent lamp electrode in which one or more rare earth metals selected from among lanthanum, cerium, yttrium, samarium, praseodymium, niobium, europium and gadolinium are dispersed in a nickel or nickel alloy base in the form of a precipitated boride phase.

Moreover, the invention relates to a method for producing a fluorescent lamp electrode comprising melting and casting nickel or nickel alloy, one or more rare earth metals selected from among lanthanum, cerium, yttrium, samarium, praseodymium, niobium, europium and gadolinium, and boron; and performing a plastic forming of an obtained ingot.

Moreover, the invention relates to a method for producing a fluorescent lamp electrode comprising melting and casting nickel or nickel alloy and boride of one or more rare earth metals selected from among lanthanum, cerium, yttrium, samarium, praseodymium, niobium, europium and gadolinium; and performing a plastic forming of an obtained ingot.

Moreover, the invention relates to a fluorescent lamp including a light transmitting tube enclosing therein mercury and rare gas; a fluorescent layer formed on an inner wall surface of the light transmitting tube; and a pair of electrodes, in which the electrodes are said fluorescent lamp electrode.

ADVANTAGEOUS EFFECTS OF INVENTION

In accordance with the invention, the fluorescent lamp electrode has excellent sputtering resistance and is able to retain excellent dark-start characteristics over a long period of time when used as an electrode in the cold cathode fluorescent lamp. The fluorescent lamp of the invention has the prolonged life time. Moreover, in accordance with the method for producing the fluorescent lamp electrode, the fluorescent lamp electrode may be produced easily and inexpensively.

Figure 1:
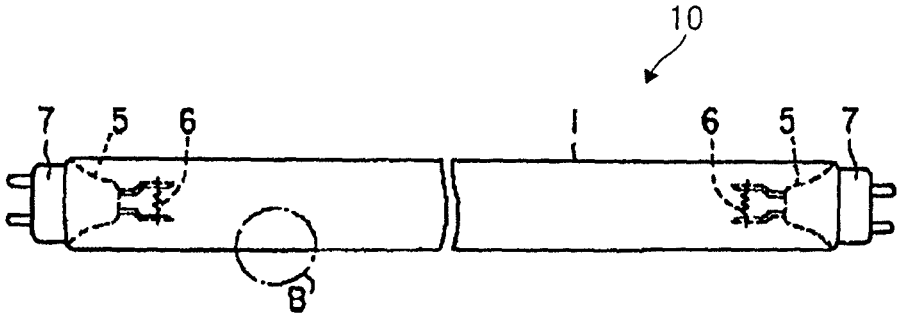
FIG. 1*a* is a schematic configuration view of one example of a hot electrode fluorescent lamp to which a fluorescent lamp electrode according to the invention is applied.
FIG. 1*b* is a partial cross-sectional view of the hot electrode fluorescent lamp in FIG. 1*a;*
Figure 1:
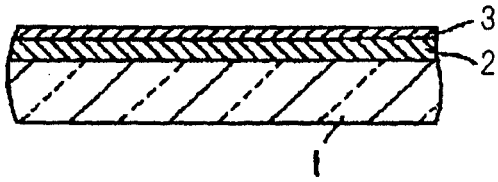

| Description of Reference Numeral | |
|---|---|
| 1, 22, 32: | glass tube |
| 2, 24a, 33a: | protection layer |
| 3, 24b, 33b: | fluorescent layer |
| 6: | electrodes |
| 10: | hot electrode fluorescent lamp |
| 21: | cold cathode fluorescent lamp |
| 27: | cup shape electrode |
| 29: | lead line |
| 31: | external electrode fluorescent lamp |
| 34: | external electrode |

DESCRIPTION OF EMBODIMENTS

Fluorescent Lamp Electrode

The fluorescent lamp electrode according to the invention is characterized in that one or more rare earth metals selected from among lanthanum, cerium, yttrium, samarium, praseodymium, niobium, europium and gadolinium are dispersed in a nickel or nickel alloy base in the form of a precipitated boride phase.

The fluorescent lamp electrode according to the invention includes the nickel or nickel alloy as a base material. Such a nickel or nickel alloy base has excellent sputtering resistance to provide excellent durability for the electrode. Moreover, the nickel has low melting point and accordingly it is possible, at low temperature, to shape the electrode or connect a lead line for supplying external power to the electrode. The nickel alloy may include alloys of the nickel and one or more metals selected from among zirconium, titanium, hafnium, yttrium and magnesium.

Within such a nickel or nickel alloy base, the nickel or nickel alloy (hereinafter, referred to as "nickel") exists in a fine crystalline particle phase. A diameter of the particle may preferably be equal to or smaller than for example 40 μm.

Here, an average diameter of the crystalline particle can adopt value which is acquired by electron-microscopically observing an electrode surface, which has been etched by an acid, and comparing the observations with standard particles shown in standard figures. To be specific, a crystalline particle in an optical photomicrograph, which image is to be magnified a hundred times of a real diameter of 0.8 mm of an area of an electrode surface, are compared with standard particles shown in a circle of diameter of 80 mm. The diameter of the crystalline particle is determined as the value corresponding with the size of the standard particle. Measurements of diameters of some crystalline particles in the optical photomicrograph are carried out repeatedly, then an average diameter of crystalline particles is calculated. This method is based on the method written in pages 189 to 193 of "Introduction to Metal Material and Structure" written by The Japan Society for Heat Treatment and published by Taiga Shuppan Co., LTD.

In the nickel or nickel alloy base, one or more rare earth metals selected from among lanthanum, cerium, yttrium, samarium, praseodymium, niobium, europium and gadolinium are dispersed in the form of a precipitated boride phase. Such a rare earth metal boride is the electron emitting material having lower work function and therefore always emits the electrons into the electrode even though the external voltage is not applied to the electrode. For this reason, when the external voltage is applied to the electrode, the electrons already emitted from such a rare earth metal boride into the electrode may function as primary electrons, so that as soon as the external voltage is applied to the electrode, the electrode starts to discharge the electrons. Accordingly, the fluorescent lamp comes to retain the excellent dark-start characteristics. It is preferable that hexaboride such as $LaB_6$, $CeB_6$, $YB_6$, $SmB_6$, $PrB_6$, $NdB_6$, $EuB_6$ or $GdB_6$ is used as the rare earth metal boride since they have further lower work function and further improve dark-start characteristics.

The rare earth metal boride is dispersed in the form of the precipitated phase in the base. When the rare earth metal boride dispersed near the surface of the base is sputtered out of the base, the precipitated phase dispersed inside the base will immediately come up to near the surface of the base. Accordingly, the fluorescent lamp electrode has the excellent sputtering resistance and at the same time retains the excellent dark-start characteristics for a long period of time. This is different from in the case in which the rare earth metal boride is provided only to the surface of the base. It is preferable that the rare earth metal boride as the precipitated phase is dispersed along boundaries of crystalline particles of the nickel. When the rare earth metal boride as the precipitated phase is dispersed along the boundaries of the crystalline particles of the nickel, the crystalline particle of the nickel is prevented from being larger in heating during for example a plastic forming process, resulting in retaining fine crystalline particles of the nickel. Meanwhile, the sputtering the electrodes by mercury and the rare gas tends to progress along the boundaries of the crystalline particles of the nickel. Therefore, the sputtering resistance of the electrode may further improve in that the rare earth metal boride as the precipitated phase is present at the boundaries of the crystalline particles of the nickel.

It is preferable that the particle diameter of the rare earth metal boride as the precipitated phase is in a range of 1.0 to 20.0 μm. The particle diameter of the precipitated phase of the rare earth metal boride is measured in the same method as in measuring that of the nickel.

It is preferable that the rare earth metal boride, in terms of the rare earth metal hexaboride, contained in the base is 0.01 to 1.50 mass %. When the content of the rare earth metal boride in the base is equal to or more than 0.01 mass %, the electrode may have excellent sputtering resistance and dark-start characteristics. When the content of the rare earth metal boride in the base is equal to or less than 1.50 mass %, the electrode has superior workability and thus is easy to fabricate irrespective of any shape of the electrode.

It is preferable that the shape of the fluorescent lamp electrode is selected depending on what kind of the fluorescent lamp intends to be employed. For example, a coil shape electrode is preferable for a hot electrode fluorescent lamp, whereas a cup shape electrode is preferable for a cold cathode fluorescent lamp.

[Method for Producing the Fluorescent Lamp Electrode]

The fluorescent lamp electrode according to the invention is produced by melting the nickel or nickel alloy and one or more rare earth metals selected from among lanthanum, cerium, yttrium, samarium, praseodymium, niobium, europium and gadolinium together with boron or melting the nickel or nickel alloy and the boride of the one or more that of rare earth metals and then casting the molten metal and then performing a plastic forming of an obtained ingot.

The melting and casting contains processes of melting aggregated metal of raw material, pouring the molten metal into a mold or its equivalent space, solidifying and then forming an ingot. The raw material to be melted includes the nickel or the nickel alloy and the rare earth metal boride; or includes the nickel or the nickel alloy, the rare earth metal and boron. Both of the case in which the rare earth metal boride is used as the raw material and the case in which the rare earth metal and boron are used as raw materials may equally result in the rare earth metal boride as the precipitated phase being found at the boundaries of the nickel particles.

It is preferable that the melting is performed under vacuum or inert gas atmosphere at approximately melting temperature of the nickel or nickel alloy, specifically, at approximately 1600° C. If the melting is performed under the vacuum or inert gas atmosphere, the ingot containing low concentration of gas may be obtained. It is preferable that the solidification after the melting is carried out in a cold removal manner because using such a cold removal way, the rare earth metal boride precipitates along the boundaries of the nickel particles throughout the base. The ingot obtained by the solidification may be formed into a plate or wire.

The resulting ingot is subjected to the plastic forming. With the plastic forming, the ingot is converted into coil material by performing hot rolling or hot forging of the wire ingot. After cleansing the resulting coil material using acid, distortions of the coli material is removed using annealing to improve ductility and at the same time a wiring rod with a diameter, for example 1 to 2.6 mm, corresponding to that of an electrode to be formed is formed by wire-drawing the coil material while performing hardness adjustment. Further, the wire rod is subjected to a header working to be formed into a desired shape such as a cylindrical shape.

Alternatively, the ingot is converted into a board with thickness, for example 0.1 to 0.2 mm, corresponding to that of an electrode to be formed by performing hot forging, hot rolling or cold rolling of the platy ingot. The resulting board is subjected to a press working to be formed into the desired shape such as a cylindrical shape. Or the board is cut in pieces and the pieces are bonded to form an electrode.

The heating temperature during the plastic forming may preferably be 900 to 1000° C. If the heating temperature is equal to or lower than 1000° C., the particle boundary crack resulting from changing the phase of rare earth metal boride from solid to liquid may be suppressed.

In accordance with the method for producing the electrode, it is easy to produce the fluorescent lamp electrode in which the rare earth metal boride as the precipitated phase is dispersed along the boundaries of crystalline particles of the nickel or nickel alloy.

[Fluorescent Lamp]

The fluorescent lamp according to the invention includes a light transmitting tube enclosing therein mercury and rare gas, a fluorescent layer formed on an inner wall surface of the light transmitting tube, and a pair of electrodes, in which the electrodes are said fluorescent lamp electrode.

The fluorescent lamp of the invention, because having the above-described electrodes, has excellent sputtering resistance and a prolonged life time and is able to retain excellent dark-start characteristics over a long period of time when being employed as the cold cathode fluorescent lamp.

The light transmitting tube used in the fluorescent lamp of the invention is preferably made of material with high transmission rate of the visible ray, such as soda-lime glass, borosilicate glass, lead glass, low lead glass, etc. The shape of the light transmitting tube may include, be not limited to, a circular tube or an ellipsoidal tube of a straight type, a curved type, or an annular type or a spiral tube in a glass bulb. Both ends of the light transmitting tube are tightly sealed and the mercury is enclosed therein so as to be 1 to 10 Pa when the lamp turns on. The inert gas such as argon, xenon, neon, etc is enclosed therein so that the inner pressure of the light transmitting tube becomes for example 30 to 100 torr and the ionized rare gas by the electrons generates the glow discharge to excite the mercury, so that the ultraviolet ray of 253.7 nm is emitted from the excited mercury.

The fluorescent layer is formed on the inner wall surface of the light transmitting tube along the substantially entire length thereof. The fluorescence in the fluorescent layer is excited by the ultraviolet ray of 253.7 nm emitted from the excited mercury atoms and emits the visible rays. The fluorescence may preferably have small degradation resulting from the heat, and small absorption of the mercury. Especially, the fluorescence may preferably have so small absorption of the mercury so that the fluorescence may preferably suppress the degradation of the light transmitting tube. When the vapor pressure of the mercury keeps on being high at the start of lighting the fluorescent lamp, it is preferably that the fluorescence may suppress to absorb the mercury. Such a fluorescence may be appropriately selected from YAG fluorescence, halophosphate fluorescence, or rare earth metal fluorescence, depending on the usage of the fluorescent lamp. For example, the fluorescence may include $Y_2O_3$:Eu, $YVO_4$:Eu, $LaPO_4$:Ce,Tb, (Ba,Eu)$MgAl_{10}O_{17}$, (Ba,Sr,Eu)(Mg,Mn)$Al_{10}O_{17}$, $Sr_{10}(PO_4)_6Cl_2$;EU, or $(Sr,Ca,Ba,Mg)_{10}(PO_4)_6Cl_2$:Eu. White light may be acquired by employing combinations of at least two sorts of fluorescence which are excited by the ultraviolet ray of 253.7 nm emitted from the excited mercury and emit and render the visible rays in red, green, and blue regions.

The electrodes with the desired shape are mounted respectively at both longitudinal ends of the light transmitting tube internally or externally. A lead line is connected to the each electrode for supplying external power to the electrode. The lead line may preferably be made of any conductive material such as kovar to emit the heat generated in turning on the lamp out of the tube.

In the fluorescent lamp, a protection layer may be set between the inner wall surface of the light transmitting tube and the fluorescent layer. The protection layer may preferably prevent the ultraviolet ray emitted by the excited mercury from leaking out of the tube and suppress the reactions between the fluorescence or mercury and precipitations from the light transmitting tube and in turn the consumption of the fluorescence or mercury. Further, the protection layer may preferably prevent the reaction products such as amalgam from being attached to the light transmitting tube and thus may suppress the degradation of transmission rate of the light transmitting tube. Material of such a protection layer may include metal oxide such as oxide yttrium.

Ionic electron emitting material may be formed nearly at the electrodes in order to improve the starting characteristics.

The fluorescent lamp of the invention may be applied to any fluorescent lamp using the fluorescent light-emission. For example, the fluorescent lamp of the invention may be very suitable to the hot electrode fluorescent lamp, the CCFL or EEFL.

The fluorescent lamp may be produced in the way of example as follows. In order to form the protection layer, dispersion liquid containing metal oxide such as oxide yttrium and regulator agent for regulating the viscosity is prepared. The dispersion liquid is applied onto the inner wall surface of the light transmitting tube by drawing up the dispersion liquid into the light transmitting tube and is dried for example at temperature 60 to 80° C. for 1 to 5 minutes to form the protection layer. For formation of the fluorescent layer, dispersion liquid containing the fluorescence such as $Y_2O_3$:Eu is prepared. The dispersion liquid is applied onto the protection layer by drawing up the dispersion liquid into the light transmitting tube and is dried for example at temperature 60 to 80° C. for 1 to 10 minutes to form the fluorescent layer. Electrodes connected to lead lines are mounted at both ends of the light transmitting tube respectively and are sealed with caps. Then, the rare gas and mercury are injected and enclosed with the light transmitting tube.

As one example of the fluorescent lamp according to the invention, the hot electrode fluorescent lamp is illustrated in FIG. 1. FIG. 1(*a*) is a schematic configuration view thereof and FIG. 1(*b*) is a cross-sectional view of a portion B in FIG. 1(*a*). Hot electrode fluorescent lamp 10 as shown in FIG. 1 includes glass tube 1 made of soda-lime glass. Glass tube 1 may have for example outer diameter of 15.5 to 38 mm. Protection layer 2 made of the metal oxide and with 1 μm thickness is formed on nearly the entirety of inner wall surface of glass tube 1. Fluorescent layer 3 with 20 to 30 μm thickness containing the fluorescence such as $Y_2O_3$:Eu is stacked on protection layer 2.

At the both ends of glass tube 1, above-mentioned electrodes 6 formed in a coil shape are fixed to stems 5 respectively. The both ends of glass tube 1 are occluded by stems 5. Predetermined amount of the argon and mercury are introduced into the inner space and then the internal pressure thereof is reduced to as approximately one of several tens as the atmospheric pressure. Caps 7 are coupled to stems 5 respectively and the external power is supplied to electrodes 6 through terminals installed to the caps.

Figure 2:
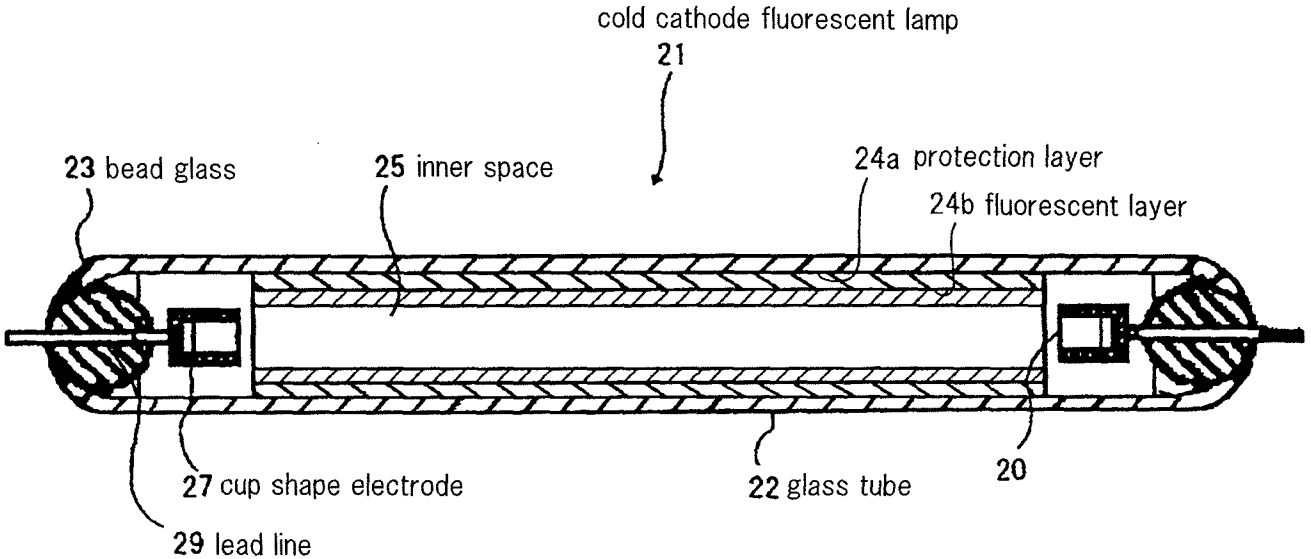
FIG. 2 is a schematic cross-sectional view of one example of a cold cathode fluorescent lamp (CCFL) to which a fluorescent lamp electrode according to the invention is applied.

As another example of the fluorescent lamp according to the invention, the cold cathode fluorescent lamp (CCFL) is illustrated in FIG. 2 in terms of a schematic cross-section. Cold cathode fluorescent lamp 21 as shown in FIG. 2 includes glass tube 22 made of the soda-lime glass whose both ends are tightly sealed with bead glasses 23 respectively. Glass tube 22 may have outer diameter of for example 1.5 to 6.0 mm, preferably 1.5 to 5.0 mm. Protection layer 24*a* made of the metal oxide and with 0.1 to 1.2 μm thickness is formed on substantially the entirety of inner wall surface of glass tube 22. Fluorescent layer 24*b* with 15 to 30 μm thickness containing the fluorescence such as $Y_2O_3$:Eu is stacked on protection layer 24*a*. Predetermined amount of the rare gas and mercury are introduced into the inner space 25 and the internal pressure thereof is reduced to as approximately one of several tens as the atmospheric pressure. Above-described electrodes 27 with a cup shape of thickness for example 0.05 to 1.0 mm and outer diameter 0.7 to 3.5 mm are mounted nearly at both ends of glass tube 22 so that openings 20 thereof face each other. One end of lead line 29 is bonded in a welding manner to the bottom face of electrode 27, and the other end of lead line 29 penetrates through bead glass 23 so as to be drawn out of glass tube 22. The external power is supplied through lead line 29 to electrode 27.

Figure 3:
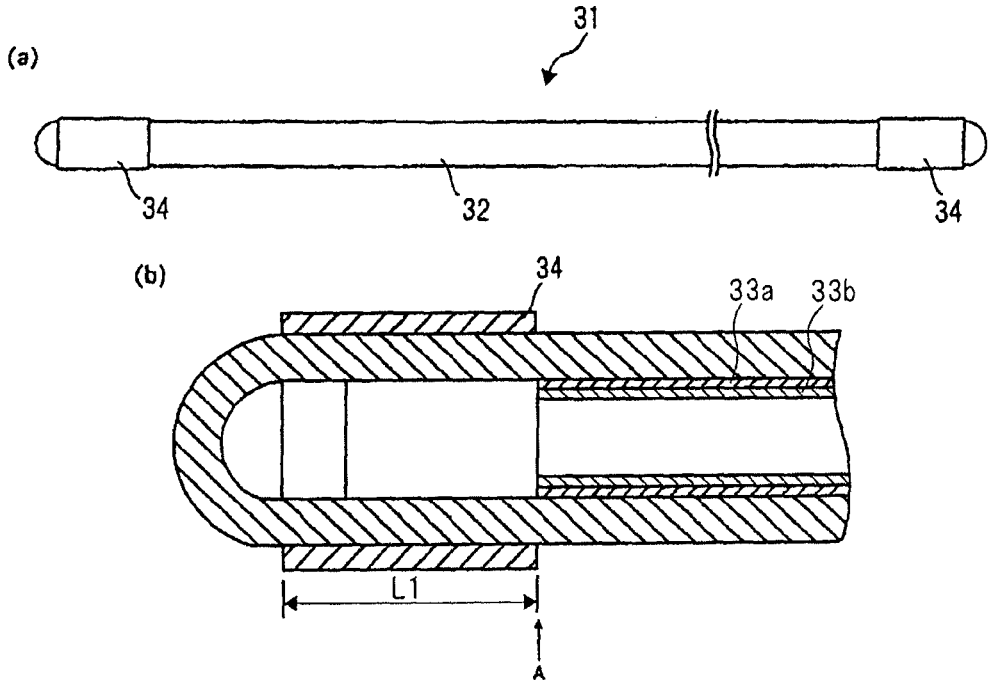
FIG. 3*a* is a side view of one example of a external electrode fluorescent lamp (EEFL) to which a fluorescent lamp electrode according to the invention is applied.
FIG. 3*b* is a schematic cross-sectional view of the external electrode fluorescent lamp in FIG. 3*a*.

As another example of the fluorescent lamp according to the invention, the external electrode fluorescent lamp (EEFL) is illustrated in FIG. 3. FIG. 3(*a*) is a side view thereof and FIG. 3(*b*) is a partial cross-sectional view of one end thereof. External electrode fluorescent lamp 31 as shown in FIG. 3 includes glass tube 32 made of the soda-lime glass whose both ends are sealed. Glass tube 32 may have outer diameter of for example 1.5 to 6.0 mm, preferably 1.5 to 5.0 mm. Protection layer 33*a* made of the metal oxide and with 0.1 to 1.2 μm thickness is formed on substantially entirety of inner wall surface of glass tube 32 except for regions in which the external electrodes are to be mounted. Fluorescent layer 33*b* of thickness 15 to 30 μm containing the fluorescence such as $Y_2O_3$:Eu is stacked on protection layer 33*a*. Predetermined amount of the rare gas and mercury are introduced into the inner space thereof and then the internal pressure thereof is reduced to as approximately one of several tens as the atmospheric pressure. External electrodes 34 such as above-described electrodes are formed on outer peripheral faces nearly at both ends of glass tube 32. External electrodes 34 may be adhered to the outer peripheral faces of glass tube using conductive adhesive agent being mixture of silicon resin and metal powder. The external electrodes 34 may cover entirety of both ends of glass tube 32. The longitudinal length L1 of the external electrode may be for example 10 to 35 mm. A Lead line (not shown) is connected to the each external electrode and the external power is supplied through the lead line to the electrode.

The fluorescent lamp has the prolonged life time because including the electrodes having the excellent sputtering resistance. Further, the fluorescent lamp is able to retain the excellent dark-start characteristics over a long period of time when used as the cold cathode fluorescent lamp.

EXAMPLES

The invention be described in more details with reference to following examples, however the invention is not limited thereto.

Example 1

Ni, La and B are weighted so as to become 99.7 mass %, 0.2 mass % and 0.1 mass respectively and then are placed into a crucible made of refractory and next are melted at 1600° C. using high frequency vacuum induction melting furnace. The obtained molten metal is injected into an iron mold under argon atmosphere and is cooled down in a cold removal manner. Mass ratios of elements in the resulting ingot are shown in Table 1.

Figure 4:
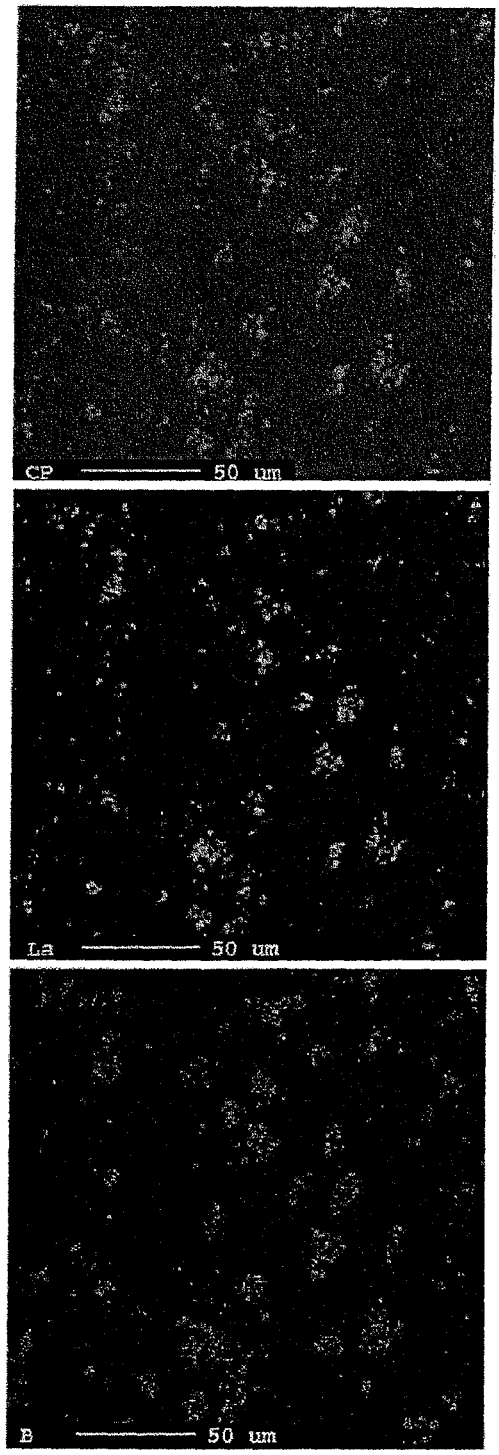
FIG. 4 shows images of one example of the fluorescent lamp electrode according to the invention measured by a X ray micro analyzer.

The ingot is subjected to a hot forging process at 900° C. and then is heated to 900° C. and is subjected to a hot rolling process, thereby obtaining wire material of 9.5 mm diameter. The wire material is cleansed with acid so that an oxide film on the surface thereof is removed. Such heating and extension operations are repeated and the wire material is wire-drawn up to 2.0 mm diameter while annealing the wire material. The resulting wire rod is subjected to a header forming to produce a cylindrical shape electrode. A mapping analysis on the cylindrical shape electrode is performed using a X ray micro analyzer (EPMA, commercially available from JEOL Ltd). The analysis results are shown in FIG. 4. It is apparent from FIG. 4 that the boron and lanthanum are located at the same place in the nickel base and are combined to form the precipitated phase.

The CCFL as shown in FIG. 2 is produced using the resulting cylindrical shape electrodes. The fluorescent layer of thickness of 15 to 30 μm is applied onto the inner wall surface of the borosilicate glass tube of length of 850 mm and thickness of 0.5 mm. The above electrodes to which the kovar lines are respectively coupled in a welding way on their bottom faces are installed respectively to both ends of the glass tube. The glass tube is sealed with a bead glass through which the kovar lines as lead lines pass. The mixture gas of the argon and neon is adjusted to 60 Torr in terms of pressure and is enclosed therein, thereby producing the CCFL. The resulting CCFL is subjected to the sputtering resistance evaluation and dark-start characteristics evaluation.

[Dark-Start Characteristics]

Darkness is brought out by winding a black cloth around the CCFL and keeping it for 48 hours. Thereafter, the voltage is applied to the CCFL and the time taken for the CCFL to start to turn on is measured. Meanwhile, as a comparison example, such dark-start test also is applied to the conventional CCFL produced in the same way at the CCFL of the invention except that it employs the conventional nickel electrodes. The comparison results between the CCFL of the invention and the conventional CCFL are shown in Table 1.

In Table 1, the case in which the CCFL of the invention is equal to the conventional CCFL in terms of the characteristics is indicated as C and the case in which the CCFL of the invention is superior to the conventional CCFL in terms of the characteristics is indicated as B, and the case in which the CCFL of the invention is very superior to the conventional CCFL in terms of the characteristics is indicated as A.

The CCFL has been activated for 500 hours with 15 mA tube current. Thereafter, the sputtered amount is observed by looking into the region near the electrodes. Meanwhile, the similar sputtering resistance test also is applied to the conventional CCFL. The comparison results between the CCFL of the invention and the conventional CCFL are shown in Table 1.

Examples 2 to 48

The fluorescent lamp electrodes are produced in the same way as in the example 1 except changing the raw materials shown in the table 1 and then fluorescent lamp is produced in the same way as the example 1. The resulting CCFLs are subjected to the sputtering resistance evaluation and dark-start characteristics evaluation in the same way as in the example 1. The comparison results between the CCFLs of the examples of the invention and the conventional CCFL are shown in Table 1.

TABLE 1

| | Chemical composition | | | | | | | | | | Characteristics | |
|---|---|---|---|---|---|---|---|---|---|---|---|---|
| | Ni | B | La | Ce | Y | Sm | Pr | Nd | Eu | Gd | Sputtering resisitance | Dark-start characteristics |
| Example1 | Bal. | 0.11 | 0.20 | — | — | — | — | — | — | — | A | A |
| Example2 | Bal. | 0.003 | 0.007 | — | — | — | — | — | — | — | A | A |
| Example3 | Bal. | 0.48 | 1.02 | — | — | — | — | — | — | — | A | A |
| Example4 | Bal. | 0.003 | 0.005 | — | — | — | — | — | — | — | B | C |
| Example5 | Bal. | 0.57 | 1.23 | — | — | — | — | — | — | — | A | A |
| Example6 | Bal. | 0.16 | — | 0.17 | — | — | — | — | — | — | A | A |
| Example7 | Bal. | 0.003 | — | 0.007 | — | — | — | — | — | — | A | A |
| Example8 | Bal. | 0.47 | — | 1.03 | — | — | — | — | — | — | A | A |
| Example9 | Bal. | 0.003 | — | 0.005 | — | — | — | — | — | — | B | C |
| Example10 | Bal. | 0.57 | — | 1.23 | — | — | — | — | — | — | A | A |
| Example11 | Bal. | 0.13 | — | — | 0.17 | — | — | — | — | — | A | A |
| Example12 | Bal. | 0.004 | — | — | 0.006 | — | — | — | — | — | A | A |
| Example13 | Bal. | 0.63 | — | — | 0.87 | — | — | — | — | — | A | A |
| Example14 | Bal. | 0.003 | — | — | 0.005 | — | — | — | — | — | B | C |
| Example15 | Bal. | 0.76 | — | — | 1.04 | — | — | — | — | — | A | A |
| Example16 | Bal. | 0.09 | — | — | — | 0.21 | — | — | — | — | A | A |
| Example17 | Bal. | 0.003 | — | — | — | 0.007 | — | — | — | — | A | A |
| Example18 | Bal. | 0.45 | — | — | — | 1.05 | — | — | — | — | A | A |
| Example19 | Bal. | 0.003 | — | — | — | 0.005 | — | — | — | — | B | C |
| Example20 | Bal. | 0.54 | — | — | — | 1.26 | — | — | — | — | A | A |
| Example21 | Bal. | 0.10 | — | — | — | — | 0.21 | — | — | — | A | A |
| Example22 | Bal. | 0.003 | — | — | — | — | 0.007 | — | — | — | A | A |
| Example23 | Bal. | 0.47 | — | — | — | — | 1.03 | — | — | — | A | A |
| Example24 | Bal. | 0.003 | — | — | — | — | 0.005 | — | — | — | B | C |
| Example25 | Bal. | 0.57 | — | — | — | — | 1.23 | — | — | — | A | A |
| Example26 | Bal. | 0.09 | — | — | — | — | — | 0.21 | — | — | A | A |
| Example27 | Bal. | 0.003 | — | — | — | — | — | 0.007 | — | — | A | A |
| Example28 | Bal. | 0.47 | — | — | — | — | — | 1.04 | — | — | A | A |
| Example29 | Bal. | 0.003 | — | — | — | — | — | 0.005 | — | — | B | C |

TABLE 1-continued

| | Chemical composition | | | | | | | | | | Characteristics | |
|---|---|---|---|---|---|---|---|---|---|---|---|---|
| | Ni | B | La | Ce | Y | Sm | Pr | Nd | Eu | Gd | Sputtering resisitance | Dark-start characteristics |
| Example30 | Bal. | 0.56 | — | — | — | — | — | 1.24 | — | — | A | A |
| Example31 | Bal. | 0.09 | — | — | — | — | — | — | 0.21 | — | A | A |
| Example32 | Bal. | 0.003 | — | — | — | — | — | — | 0.007 | — | A | A |
| Example33 | Bal. | 0.45 | — | — | — | — | — | — | 1.05 | — | A | A |
| Example34 | Bal. | 0.002 | — | — | — | — | — | — | 0.006 | — | B | C |
| Example35 | Bal. | 0.54 | — | — | — | — | — | — | 1.26 | — | A | A |
| Example36 | Bal. | 0.09 | — | — | — | — | — | — | — | 0.21 | A | A |
| Example37 | Bal. | 0.003 | — | — | — | — | — | — | — | 0.007 | A | A |
| Example38 | Bal. | 0.44 | — | — | — | — | — | — | — | 1.06 | A | A |
| Example39 | Bal. | 0.002 | — | — | — | — | — | — | — | 0.006 | B | C |
| Example40 | Bal. | 0.53 | — | — | — | — | — | — | — | 1.27 | A | A |
| Example41 | Bal. | 0.16 | 0.17 | 0.17 | — | — | — | — | — | — | A | A |
| Example42 | Bal. | 0.16 | 0.17 | — | — | 0.18 | — | — | — | — | A | A |
| Example43 | Bal. | 0.16 | — | 0.17 | — | — | 0.17 | — | — | — | A | A |
| Example44 | Bal. | 0.18 | — | — | 0.15 | — | — | 0.17 | — | — | A | A |
| Example45 | Bal. | 0.16 | — | — | — | 0.17 | — | — | 0.18 | — | A | A |
| Example46 | Bal. | 0.15 | — | — | — | — | 0.17 | — | — | 0.18 | A | A |
| Example47 | Bal. | 0.28 | 0.18 | 0.18 | 0.15 | — | — | — | — | — | A | A |
| Example48 | Bal. | 0.24 | 0.18 | 0.18 | — | 0.18 | — | — | — | — | A | A |

It is apparent from the results that the nickel base electrode of the invention in which the rare earth metal boride is precipitated with 0.01 to 1.50 mass % in the nickel base using the melting and casting method comes into being superior to the conventional nickel base electrode in the terms of the sputtering resistance and dark-start characteristics.

This application claims priority from Japanese Patent Application No. 2008-165714 filed on Jun. 25, 2008, which is hereby incorporated by reference herein.

INDUSTRIAL APPLICATION FIELD

The fluorescent lamp electrode according to the invention may be very appropriately applied to the hot electrode fluorescent lamp, the cold cathode fluorescent lamp (CCFL) or the external electrode fluorescent lamp (EEFL) for the illumination because having the excellent sputtering resistance. Especially, the fluorescent lamp electrode according to the invention may be very appropriately applied to the CCFL used as a backlight of a liquid crystal display set in a device such as a television or a computer, a scanning light source of a facsimile or an eraser light source of a copying machine, or used for various indications because being able to retain the excellent dark-start characteristics over a long period of time.

The invention claimed is:

1. A fluorescent lamp electrode in which one or more rare earth metals selected from among lanthanum, cerium, yttrium, samarium, praseodymium, niobium, europium and gadolinium are dispersed in a nickel or nickel alloy base in the form of a precipitated boride phase, and the rare earth metal boride as the precipitated phase is dispersed along boundaries of crystalline particles of the nickel or nickel alloy.

2. The fluorescent lamp electrode of claim 1, wherein the boride of the rare earth metal is rare earth metal hexaboride.

3. The fluorescent lamp electrode of claim 1 wherein the rare earth metal boride, in terms of rare earth metal hexaboride, contained in the base is 0.01 to 1.50 mass %.

4. A fluorescent lamp comprising a light transmitting tube enclosing therein mercury and rare gas, a fluorescent layer formed on an inner wall surface of the light transmitting tube, and a pair of electrodes, wherein the electrodes are the fluorescent lamp electrode of claim 1.

5. The fluorescent lamp electrode of claim 2, wherein the rare earth metal boride, in terms of rare earth metal hexaboride, contained in the base is 0.01 to 1.50 mass %.

6. A fluorescent lamp comprising a light transmitting tube enclosing therein mercury and rare gas, a fluorescent layer formed on an inner wall surface of the light transmitting tube, and a pair of electrodes, wherein the electrodes are the fluorescent lamp electrode of claim 2.

7. A fluorescent lamp comprising a light transmitting tube enclosing therein mercury and rare gas, a fluorescent layer formed on an inner wall surface of the light transmitting tube, and a pair of electrodes, wherein the electrodes are the fluorescent lamp electrode of claim 3.

* * * * *

UNITED STATES PATENT AND TRADEMARK OFFICE

CERTIFICATE OF CORRECTION

PATENT NO. : 8,446,086 B2
APPLICATION NO. : 13/000295
DATED : May 21, 2013
INVENTOR(S) : Toshikazu Sugimura et al.

It is certified that error appears in the above-identified patent and that said Letters Patent is hereby corrected as shown below:

In the Specification

Column 6, Line 65: Delete "$Cl_2$;EU," and insert -- $C_{12}$:EU, --

Column 6, Line 65: Delete "$Cl_2$:" and insert -- $C_{12}$: --

Column 8, Line 67: Delete "mass" and insert -- mass % --

Signed and Sealed this
Twenty-eighth Day of October, 2014

Michelle K. Lee

Michelle K. Lee
*Deputy Director of the United States Patent and Trademark Office*